US012085307B2

(12) United States Patent
Bonk

(10) Patent No.: US 12,085,307 B2
(45) Date of Patent: Sep. 10, 2024

(54) OFF-RIDGE ROOF VENT WITH INTERNAL AND EXTERNAL WATER DIVERTERS

(71) Applicant: Scott D. Bonk, Fort Meyers, FL (US)

(72) Inventor: Scott D. Bonk, Fort Meyers, FL (US)

( * ) Notice: Subject to any disclaimer, the term of this patent is extended or adjusted under 35 U.S.C. 154(b) by 448 days.

(21) Appl. No.: 17/506,978

(22) Filed: Oct. 21, 2021

(65) Prior Publication Data

US 2022/0042691 A1 Feb. 10, 2022

Related U.S. Application Data

(63) Continuation-in-part of application No. 16/854,857, filed on Apr. 21, 2020, now abandoned.

(51) Int. Cl.
*F24F 7/02* (2006.01)

(52) U.S. Cl.
CPC ..... *F24F 7/02* (2013.01)

(58) Field of Classification Search
CPC ..... F24F 7/02
USPC ..... 454/339, 365, 367, 368
See application file for complete search history.

(56) References Cited

U.S. PATENT DOCUMENTS

| | | | | |
|---|---|---|---|---|
| 2,447,472 A | 8/1948 | Donley | | |
| 2,565,131 A | 8/1951 | Johnson | | |
| 2,628,551 A * | 2/1953 | Leigh | F24F 7/02 | 454/366 |
| 6,202,372 B1 | 3/2001 | Powell | | |
| 7,044,852 B2 | 5/2006 | Horton | | |
| 7,544,124 B2 * | 6/2009 | Polston | F24F 7/02 | 454/366 |
| 8,292,707 B2 | 10/2012 | Grisham et al. | | |
| D705,419 S | 5/2014 | Leonard | | |
| 2007/0049190 A1 | 3/2007 | Singh | | |
| 2008/0287055 A1 * | 11/2008 | Exposito | F24F 7/02 | 454/367 |
| 2009/0011382 A1 | 6/2009 | Osborne | | |

* cited by examiner

*Primary Examiner* — Avinash A Savani
*Assistant Examiner* — Dana K Tighe
(74) *Attorney, Agent, or Firm* — Nath, Goldberg & Meyer; Joshua B. Goldberg

(57) ABSTRACT

The off-ridge roof vent with internal and external water diverters includes a throat, a hood and the water diverters. The throat has a front throat wall, a rear throat wall and a pair of longitudinally opposed throat sidewalls. The throat has open upper and lower ends. The hood has an upper hood wall that is convex upward, a pair of longitudinally opposed hood sidewalls and a lower hood wall. A lower end of the hood has a front portion that is open, wherein a perforated grating mounted therein. An internal water diverter extends upwardly from the front edge of the lower hood wall and slopes above the grating and the external water diverter extends downwardly from the front face of the hood at its terminal end portion.

16 Claims, 4 Drawing Sheets

OFF-RIDGE ROOF VENT WITH INTERNAL AND EXTERNAL WATER DIVERTERS

CROSS REFERENCE TO RELATED APPLICATIONS

This application is a continuation-in-part of application Ser. No. 16/854,857, filed Apr. 21, 2020, now pending.

BACKGROUND

1. Field

The disclosure of the present patent application relates to attic and roof ventilation, and particularly to an off-ridge roof vent with an internal water diverter.

2. Description of the Related Art

Numerous designs for attic and roof vents are known for providing ventilation to areas beneath building roofs. The ventilation of such areas is desirable to reduce the accumulation of heat in the summer, and to reduce the accumulation of moisture at all times of the year. In providing ventilation, it is important to prevent the entry of water into the building through the vent. It is also important to prevent debris and small animals from entering the building through the vent.

A common type of off-ridge roof vent uses a simple duct having a baffle mechanism over the top to prevent the entry of rain into the building. A variation of this simple design is the turbine-type roof vent, which uses a rotating element on the exterior of the duct and interior baffles to prevent the entry of water into the building. However, such off-ridge roof vents provide only a limited area through which air and moisture may escape from the structure. Further, such designs typically extend a considerable height from the surface of the roof, making them vulnerable to being knocked from the roof by tree limbs, wires, or simply the wind itself.

Other designs fit more closely to the surface of the roof, and provide a long rectangular opening through which air and moisture may exit the structure. Generally, a slot is cut in the roof that is slightly smaller than the footprint of the vent. The slot then communicates with a passageway that, in profile, is generally in the shape of an inverted "J" or gooseneck. Thus, the opening of the vent faces down, towards the roofing surface. In this way, water is prevented from entering the structure. Such vents may also be provided with a mesh or screen covering the opening, to prevent the entry of debris or small animals into the structure. However, such low profile designs suffer from a number of disadvantages. For example, such vents are typically vulnerable to damage by wind or by impact from debris. Typically, damage from the wind to such vents is in the form of bent or deformed top pieces or hoods. Such damage makes the vent more easily penetrated by rain and debris, since portions of the vent opening are enlarged, and the damage often results in deformation of those portions of the vent that interface with the surface of the roof, thus interfering with the proper sealing of the vent to the roof surface. Additionally, although the inverted "J" shape of the hood may prevent entry of water from rain falling straight down on the hood, water that is being blown by the wind may still be able to enter the vent. Thus, an off-ridge roof vent with an internal water diverter solving the aforementioned problems is desired.

SUMMARY

In one embodiment of the invention, the off-ridge roof vent with an internal water diverter is adapted for mounting on a roof of a building. The off-ridge roof vent with an internal water diverter includes a throat, a hood and a water diverter. The throat has a front throat wall, a rear throat wall and a pair of longitudinally opposed throat sidewalls. The throat has an open upper end and an open lower end. The hood has an upper hood wall with a convex cross section, a pair of longitudinally opposed hood sidewalls and a lower hood wall. A lower end of the hood has a rear portion, a central portion and a front portion, where the rear portion is open and is aligned with, and is in open communication with, the open upper end of the throat. The lower hood wall defines the central portion of the lower end of the hood and projects forward from the front throat wall. The front portion of the lower end of the hood is open. The convex cross section of the upper hood wall provides for smooth air flow over the vent.

A water diverter is formed in the lower hood wall and projects upward therefrom to prevent water from the external environment being blown into the throat through the open front portion of the lower end of the hood. A screen may be provided for covering the front portion of the lower end of the hood. Further, a peripheral flange may be secured to, and extend around, the open lower end of the throat.

It should be understood that the off-ridge roof vent with an internal water diverter may be formed from any suitable type of wind and water resistant material. Examples of such material include aluminum-zinc-coated steel and aluminum. It should be further understood that the various components of the off-ridge roof vent with an internal water diverter may be joined to one another using any suitable method. Preferably, Pittsburgh seams are used.

In a second embodiment of the invention, the off-ridge roof vent with an internal water diverter is similar to the first embodiment but has been provided with an additional external diverter located on the outside of the vent face. The internal and external diverters work together in a synergistic fashion to prevent water and air intrusion (often called "wind-driven rain") even during high wind conditions (e.g., 70-110 MPH).

In the second embodiment of the invention, the use of the internal and external diverters is not dependent on any specific type of off-ridge roof vent. The different types of off-ridge roof vent (e.g., a simple duct having a baffle mechanism over the top to prevent the entry of rain into the building; or a turbine-type roof vent, which uses a rotating element on the exterior of the duct and interior baffles to prevent the entry of water into the building; or a slot-type vent cut in the roof that is slightly smaller than the footprint of the vent, wherein the slot then communicates with a passageway that, in profile, is generally in the shape of an inverted "J" or gooseneck; or the off-ridge roof vent described in the first embodiment) can all be designed to possess the dual water diverter system. For example, in the first embodiment, the internal diverter can be attached to the lower hood wall that defines the central portion of the lower end of the hood and extends forward from the front throat wall; or the internal diverter can be attached directly to the front throat wall, rather than at the lower hood wall thereby leaving the lower hood wall as the attachment point for one end of the screen.

Regardless of the design for the internal diverter, the external diverter is located on the outside of the vent face and is acutely angled downward from the horizontal to divert air and water downward rather than straight to the throat. The internal and external diverters can be separate parts of the vent and fastened to the vent structure (e.g., welding) or they may be formed as a continuous structure defining a single, unitary duct or air passage from the lower end of the throat to the grating mounted in the front portion 40 of the lower end of the hood.

These and other features of the present subject matter will become readily apparent upon further review of the following specification.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
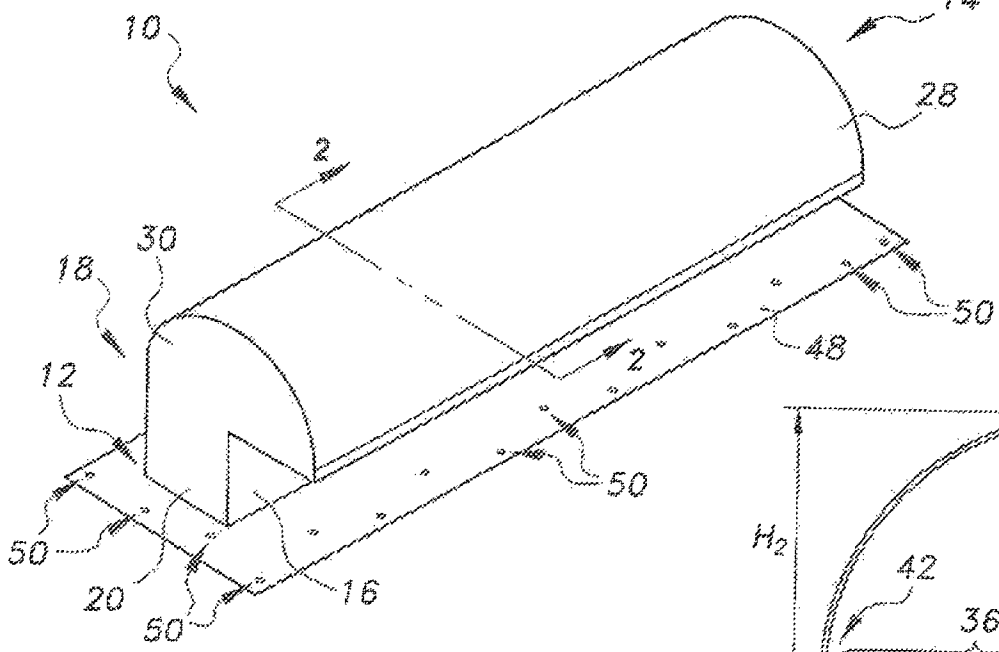
FIG. 1 is a perspective view of an off-ridge roof vent with an internal water diverter.
Figure 2:
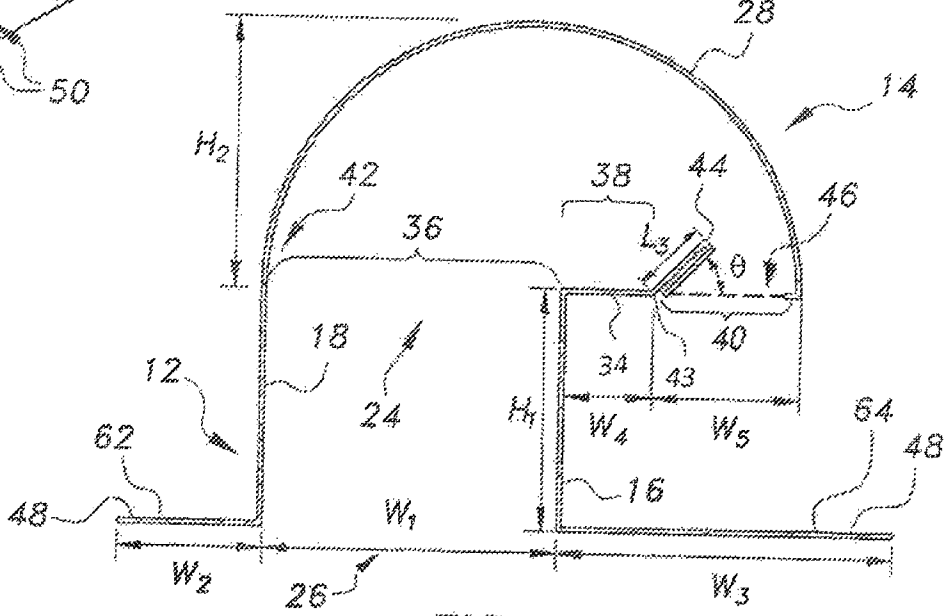
FIG. 2 is a section view taken along lines 2-2 of FIG. 1.
Figure 4:
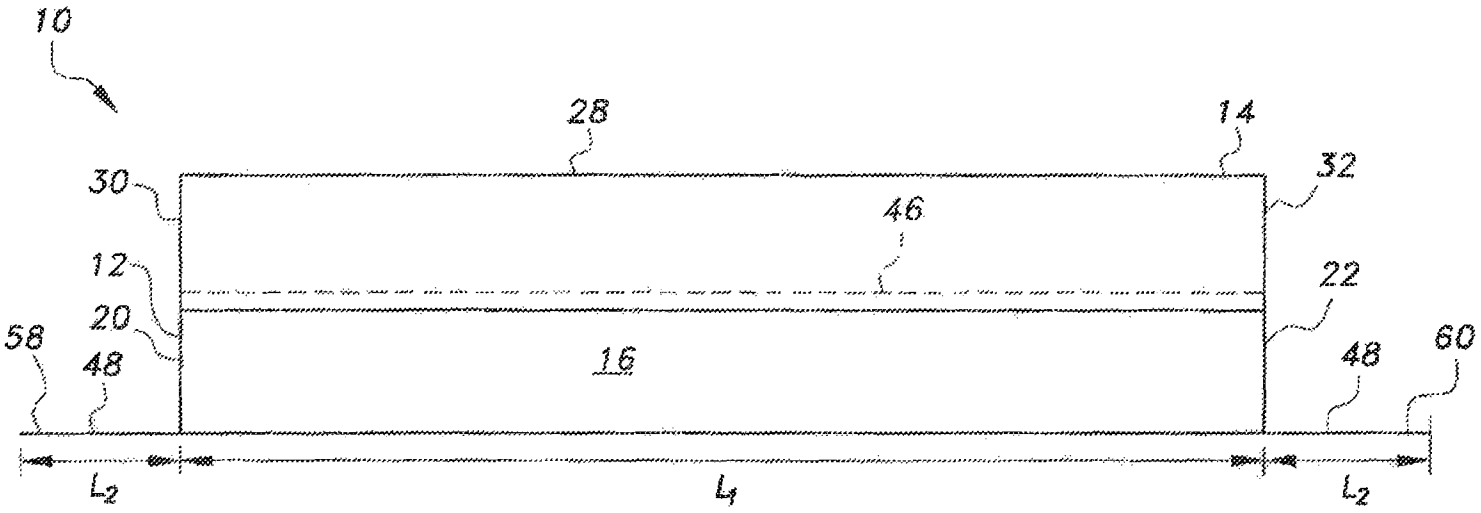
FIG. 4 is a front view of the off-ridge roof vent of FIG. 1.

The off-ridge roof vent with an internal water diverter, designated generally as 10 in the drawings, is adapted for mounting on a roof of a building. As shown in FIGS. 1-2 and 4, the off-ridge roof vent 10 includes a duct illustrated as throat 12, a hood 14 and an internal water diverter 44. The throat 12 has a front throat wall 16, a rear throat wall 18 and a pair of longitudinally opposed throat sidewalls 20, 22. The throat 12 has an open upper end 24 and an open lower end 26. The hood 14 has an upper hood wall 28 with a convex cross section, i.e., the upper hood wall 28 is convex upward, a pair of longitudinally opposed hood sidewalls 30, 32, and a lower hood wall 34. A lower end 43 of the hood 14 has a rear portion 36, a central portion 38 and a front portion 40, where the rear portion 36 is open and is aligned with, and is in open communication with, the open upper end 24 of the throat 12. The lower hood wall 34 defines the central portion 38 of the lower end 43 of the hood 14 and extends forward from the front throat wall 16. The front portion 40 of the lower end 43 of the hood 14 has a grating 46 mounted therein. The convex external surface of the upper hood wall 28, 28' (FIG. 5), and 28" (FIG. 6) provides for smooth air flow over the vent 10, while the concave inner surface of the upper hood wall gradually bends the flow of air exiting the attic 180° to flow out through the hood 14 and bends the flow of air entering through the grating 46 by 180° to flow into the attic through the throat 12 to try to equilibrate the temperature and pressure of the interior and exterior air. It will be noted that the front throat wall 16 acts as a partition separating the two air flows, which are substantially parallel to each other, but in opposite directions. Although the throat 12 and the hood 14 have been described as separate parts of the vent 10, it will be understood that the throat 12 and the hood 14 form a continuous structure defining a single, unitary duct or air passage from the lower end 26 of the throat to the grating 46 mounted in the front portion 40 of the open lower end 43 of the hood 14 for the passage of air between the attic spaces and the exterior of the building and vice versa.

An internal water diverter 44 is formed in the lower hood wall 34 between the central portion 38 of the lower end 43 of the hood 14 and the grating 46 and projects upward at an angle of about 45° to prevent water from the external environment being blown into the throat 12 through the grating 46 mounted in the front portion of the lower end 43 of the hood 14. Further, a peripheral mounting flange (or flanges) 48 may be secured to, and extend around, the open lower end 26 of the throat 12. As shown in FIG. 1, apertures 50 may be formed in the flange 48 for fasteners for attaching the vent 10 to the roof, the apertures 50 being spaced 4" on center and staggered, and a minimum of 1" from the edge of the flange 48.

Figure 3:
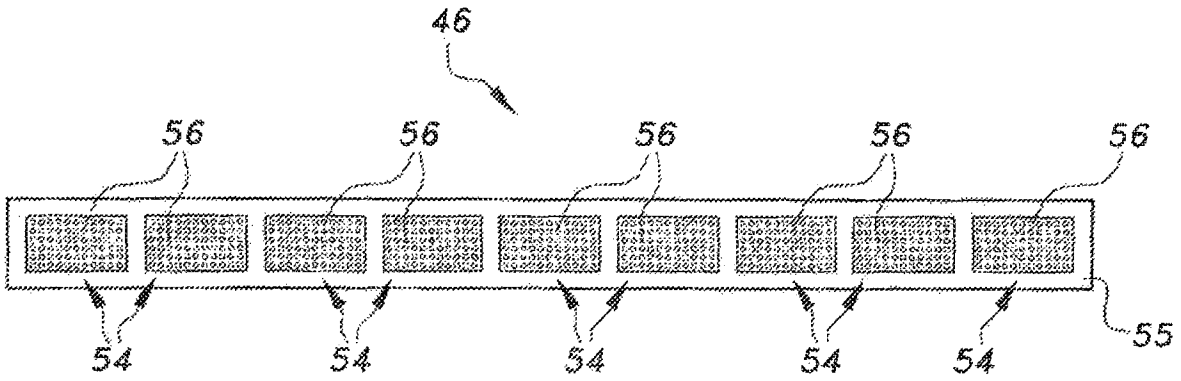
FIG. 3 is front view of a vent grating for the off-ridge roof vent of FIG. 1.

As best seen in FIG. 2, the peripheral flange 48 may be parallel to the lower hood wall 34. Further, the front throat wall 16 may extend orthogonally with respect to the peripheral flange 48 and the lower hood wall 34. The rear throat wall 18 may also be parallel to the front throat wall 16. The water diverter 44 may be angled upwardly from a plane defined by the lower hood wall 34 at an angle θ of 45°. Further, the grating 46 may be provided for covering the front portion 40 of the lower end 42 of hood 14. As shown in FIG. 3, an example of the grating 46 may be formed as an elongated wall 55 with a linear array of perforated grids 54 formed therein. Other configurations for the grating 46 may be, for example, a continuous linear array extending between the longitudinally opposed hood sidewalls 30, 32, as depicted in FIG. 4. The holes 56 defining the perforations permit the flow of air into and out of the vent 10 while resisting the passage of water.

It should be understood that the off-ridge roof vent with an internal water diverter 10 may be formed from any suitable type of wind and water resistant material. Preferably, the vent 10 is made from 26-gauge galvalume (steel sheet metal coated with Galvalume® [a registered trademark of BIEC International, Inc. of Vancouver, Washington, referring to a coating containing about 55% zinc, 43-44% aluminum, and trace amounts of silicon] or 0.032-inch aluminum. It should be further understood that the various components of the off-ridge roof vent 10 with an internal water diverter may be joined to one another using any suitable method. Preferably, the sides, flanges, and grating are joined to the body of the vent 10 by Pittsburgh seams (a sheet metal joint where on sheet has a 90° flange inserted in a pocket formed in the second sheet, which is covered by bending a flap on the second sheet), thereby providing a seam or joint that is resistant to penetration by water. The holes 56 in the perforated grids 54 may be formed directly in the sheet metal thereby avoiding the use of a grating 46 to cover the external openings of the vent 10.

It should also be understood that the relative dimensions of the off-ridge roof vent 10 shown in FIGS. 1-3 are for exemplary purposes only. For example, corresponding to a vent having a nominal length of four feet, the longitudinal length $L_1$ of front throat wall 16, 16' (FIG. 5) and 16"(FIG. 6), rear throat wall 18 and 18' (FIG. 5) grating 46 and upper hood wall 28 may be 46¼ inches. Corresponding to this exemplary length, the side portions 58, 60 of the peripheral flange 48 may each have a width $L_2$ of 2⅝ inches. Corresponding to these exemplary dimensions, the open lower end of throat 12 may have a lateral width $W_1$ of 6½ inches, the rear portion 62 of the peripheral flange 48, 48' (FIG. 5), and 48" (FIG. 6) may have a lateral width $W_2$ of 3 inches, and the front portion 64 of the peripheral flange 48 may have a lateral width $W_3$ of 7 inches. Corresponding to these exemplary dimensions, the height $H_1$ of the throat 12 may be 5 inches, and the height $H_2$ of the hood 14 may be 6⅜ inches. Corresponding to these exemplary dimensions, a lateral width $W_4$ of the lower hood wall 34 may be 2 inches, a lateral width $W_5$ of the grating 46 may be 3 inches, and a length $L_3$ of the water diverter 44 may be 1½ inches. Additionally, corresponding to these exemplary dimensions, the spacing between adjacent grids 54 of the grating 46, and the width of the wall 55 surrounding each opening 54 may be ½ of an inch.

In a second and third embodiment of the invention, the off-ridge roof vent may be similar to the first embodiment as depicted in FIG. 1 and described dimensionally above. The difference between the two additional embodiments is that the latter embodiments have been provided with both internal 44', 44" and external 70, 70' water diverters. The internal and external diverters work together in a synergistic fashion to prevent water and air intrusion even during high wind conditions (e.g., 70-110 MPH).

In the second and third embodiments of the invention, the use of the internal and external diverters is not dependent on any specific type of off-ridge roof vent. The different types of off-ridge roof vent (e.g., a simple duct having a baffle mechanism over the top to prevent the entry of rain into the building; or a turbine-type roof vent, which uses a rotating element on the exterior of the duct and interior baffles to prevent the entry of water into the building; or a slot-type vent cut in the roof that is slightly smaller than the footprint of the vent, wherein the slot then communicates with a passageway that, in profile, is generally in the shape of an inverted "J" or gooseneck; or the off-ridge roof vent described in the first embodiment) can all be designed to possess the dual water diverter system. For example, in the second embodiment depicted in FIG. 5, the internal diverter 44' can be attached to the front throat wall 16' extends forward from the front throat wall and can provide lower wall LW portions used to attach the grating or screen thereto; or in a third embodiment, as depicted in FIG. 6, the internal diverter can be attached directly to the front throat wall 16", rather than at the lower hood wall thereby leaving the lower hood wall as the attachment point for one end of the screen.

Figure 5:
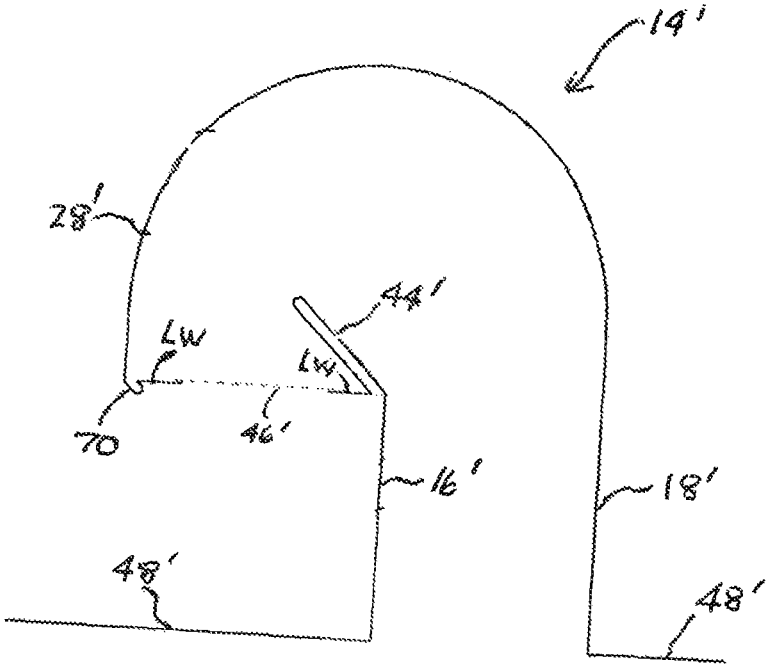
FIG. 5 is a section view similar to FIG. 2 of a second embodiment of the off-ridge roof vent.
Figure 6:
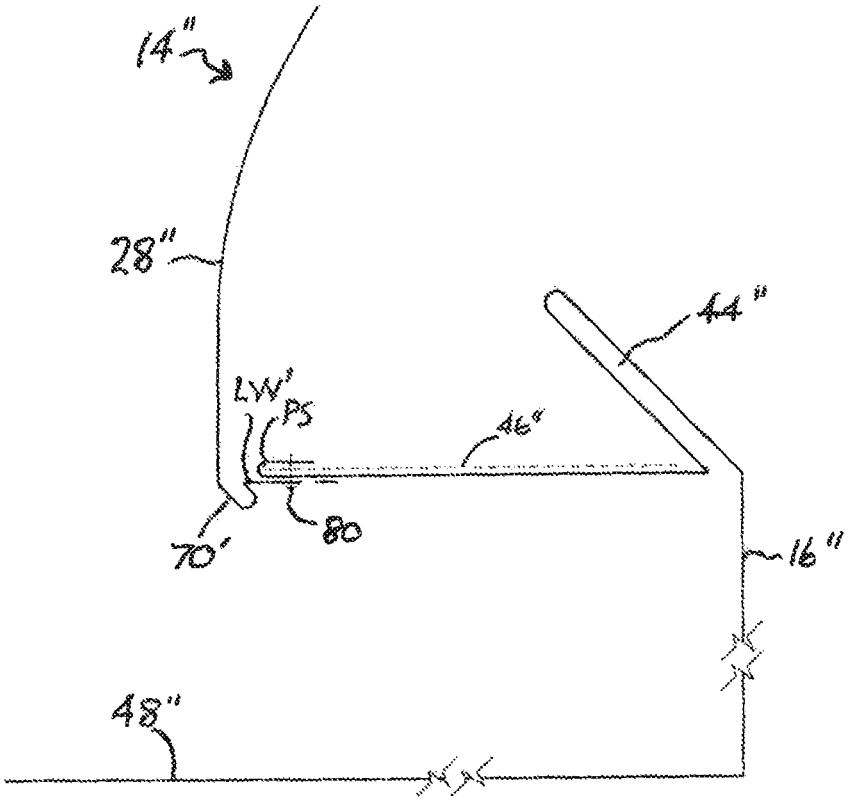
FIG. 6 is a section view similar to FIG. 5 of a third embodiment of the off-ridge roof vent.

In an exemplary method of attaching the grating or screen 46' to the front throat, FIG. 5 depicts the grating or screen 46' pressed into the Pittsburgh lock seam PS and fastened therein by fasteners 80. Conventionally, the fasteners are "self-drilling HVAC roofing screws" colloquially called TEK® screws that commonly possess hex-shaped washer heads.

Regardless of the design for the internal diverter, the external diverter is located on the outside of the vent face and is acutely angled downward from the horizontal to divert air and water downward rather than straight to the throat. The internal and external diverters can be separate parts of the vent and fastened to the vent structure; for example, welding or usage of the conventional Pittsburgh lock which, when folded, forms the seam are exemplary mechanisms; or they may be formed as a continuous structure defining a single, unitary duct or air passage from the lower end of the throat to the grating mounted in the front portion 40 of the lower end of the hood.

It should also be understood that the relative dimensions of the off-ridge roof vent 10 shown in the first embodiment can be similarly used in the second embodiment. For example, while the dimensions and materials used are similar in both embodiments, while the exemplary dimensions for the length of the internal diverter is 3⅝" at a 45 degree angle to the horizontal and the external diverter having a length between ¾-1.0 inch at a 30 degree angle from the horizontal.

It is to be understood that the off-ridge roof vent with an internal water diverter is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

I claim:

1. An off-ridge roof vent with internal and external water diverters, comprising a vent body having:

a throat portion, including:

a front throat wall;

a rear throat wall; and a pair of longitudinally opposed throat sidewalls extending between the front throat wall and the rear throat wall;

a hood portion, including:

an upper hood wall, the upper hood wall being convex upward and defining a front face, wherein the front face has a terminal end portion;

a pair of longitudinally opposed hood sidewalls disposed on opposite sides of the upper hood wall; and a lower hood wall, the hood portion having a lower end having a rear portion, a central portion and a front portion, the rear portion being open, aligned with, and in open communication with an open upper end of the throat portion, the lower hood wall defining the central portion of the lower end of the hood portion and projecting forward from the front throat wall, the front portion defining a vent opening, the throat portion and the hood portion defining a duct providing a continuous air passage from interior air spaces to exterior environmental air above a roof;

the internal water diverter extending at an acute angle from the lower hood wall above a portion of the vent opening, diverting water to drip downward and out the vent opening onto the roof;

the external water diverter extending at an acute angle downwardly from the terminal end portion of the front face of the upper hood wall, diverting water to drip downward and out the vent opening onto the roof, wherein the external water diverter extends from and between the terminal end portion of the front face of the upper hood wall to a point located between the front face of the upper hood wall and the front throat wall; and a grating disposed in the vent opening, the grating having a plurality of perforations defined therein permitting passage of air between the interior air spaces and the exterior environmental air above the roof.

2. The off-ridge roof vent as recited in claim 1, wherein the grating comprises an elongated wall having a linear array of perforated grids formed therein.

3. The off-ridge roof vent as recited in claim 1, wherein the internal water diverter is angled upwardly from a horizontal plane by an angle of 45°.

4. The off-ridge roof vent as recited in claim 1, wherein the vent body is made from a material selected from the group consisting of galvalume sheet metal and aluminum sheet metal.

5. The off-ridge roof vent according to claim 1, wherein the external water diverter is angled downwardly from a horizontal plane by an angle of 30°.

6. The off-ridge roof vent according to claim 1, wherein the internal water diverter is 3⅝" in length.

7. The off-ridge roof vent according to claim 1, wherein the external water diverter is between ¾ and 1.0 inches in length.

8. The off-ridge roof vent according to claim 1, wherein each of the internal and external water diverters comprises a lower wall, the grating being mounted therebetween.

9. An off-ridge roof vent with internal and external water diverters, comprising a vent body having:

a throat portion, including:

a front throat wall;

a rear throat wall; and a pair of longitudinally opposed throat sidewalls extending between the front throat wall and the rear throat wall;

a hood portion, including:

an upper hood wall, the upper hood wall being convex upward and defining a front face, wherein the front face has a terminal end portion;

a pair of longitudinally opposed hood sidewalls disposed on opposite sides of the upper hood wall; and a lower hood wall, the hood portion having a lower end having a rear portion, a central portion and a front portion, the rear portion being open, aligned with, and in open communication with an open upper end of the throat portion, the lower hood wall defining the central portion of the lower end of the hood portion and projecting forward from the front throat wall, the front portion defining a vent opening, the throat portion and the hood portion defining a duct providing a continuous air passage from interior air spaces to exterior environmental air above a roof;

the internal water diverter extending at an acute angle from the lower hood wall above a portion of the vent opening, diverting water to drip downward and out the vent opening onto the roof;

the external water diverter extending at an acute angle downwardly from the terminal end portion of the front face of the upper hood wall, diverting water to drip downward and out the vent opening onto the roof; and a grating disposed in the vent opening, the grating having a plurality of perforations defined therein permitting passage of air between the interior air spaces and the exterior environmental air above the roof, wherein each of the internal and external water diverters comprises a lower wall, the grating being mounted therebetween.

10. The off-ridge roof vent as recited in claim 9, wherein the grating comprises an elongated wall having a linear array of perforated grids formed therein.

11. The off-ridge roof vent as recited in claim 9, wherein the internal water diverter is angled upwardly from a horizontal plane by an angle of 45°.

12. The off-ridge roof vent as recited in claim 9, wherein the vent body is made from a material selected from the group consisting of galvalume sheet metal and aluminum sheet metal.

13. The off-ridge roof vent according to claim 9, wherein the external water diverter is angled downwardly from a horizontal plane by an angle of 30°.

14. The off-ridge roof vent according to claim 9, wherein the internal water diverter is 3⅝" in length.

15. The off-ridge roof vent according to claim 9, wherein the external water diverter is between ¾ and 1.0 inches in length.

16. The off-ridge roof vent according to claim 9, wherein the external water diverter extends from and between the terminal end portion of the front face of the upper hood wall to a point located between the front face of the upper hood wall and the front throat wall.

* * * * *